US006050852A

United States Patent [19]

Wu

[11] Patent Number: 6,050,852

[45] Date of Patent: Apr. 18, 2000

[54] ELECTRICAL CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/046,782

[22] Filed: Mar. 23, 1998

[30] Foreign Application Priority Data

| | | | |
|---|---|---|---|
| Mar. 22, 1997 | [TW] | Taiwan | 86204553 |
| Apr. 16, 1997 | [TW] | Taiwan | 86206415 |
| Apr. 19, 1997 | [TW] | Taiwan | 86206416 |

[51] Int. Cl.[7] ..... H01R 13/648

[52] U.S. Cl. ..... 439/607; 439/97

[58] Field of Search ..... 439/607–610, 439/97, 101, 108, 362

[56] References Cited

U.S. PATENT DOCUMENTS

| | | | |
|---|---|---|---|
| 5,163,851 | 11/1992 | Hart et al. | 439/567 |
| 5,169,343 | 12/1992 | Andrews | 439/608 |
| 5,288,244 | 2/1994 | Lien | 439/362 |
| 5,603,639 | 2/1997 | Lai et al. | 439/607 |
| 5,688,145 | 11/1997 | Liu | 439/607 |
| 5,876,247 | 3/1999 | Hashimoto | 439/607 |

*Primary Examiner*—Khiem Nguyen

[57] ABSTRACT

An electrical receptacle connector includes a dielectric housing having a body portion receiving a number of contacts therein and two ears each defining a central hole with a hexagonal upper section and a round lower section and two elongate slits. A shielding/grounding shell is formed with a body portion covering the body portion of the housing, and two wings each formed with four mounting tongues fittingly positioned on four mounting seats defined in the hexagonal upper section of the hole of the corresponding ear and two grounding feet extending through the corresponding slits. Two conductive posts are each formed with a domed upper section located above the body portion of the shielding/grounding shell, a middle hexagonal section positioned on the corresponding tongues of the shielding/grounding shell, and a lower cylindrical section received in the corresponding round lower section of the corresponding hole and defining a threaded portion therein. When screws are inserted through a printed circuit board to threadedly engage with the threaded portions to fix the connector on the printed circuit board, the hexagonal sections of the posts tightly urge the tongues against the mounting seats to fix the shielding/grounding shell to the housing of the connector.

24 Claims, 16 Drawing Sheets

ELECTRICAL CONNECTOR

BACKGROUND OF THE INVENTION

1. Field of the Invention

The present invention relates to an electrical connector, particularly to an electrical receptacle connector for mating with an electrical plug connector.

2. The Prior Art

The technology of using mating connectors to connect two electrical components (usually a daughter board and a mother board) is widely utilized in the electronics industry. To provide electromagnetic protection and electrostatic discharging capabilities the connectors are usually equipped with electromagnetic shielding and grounding devices. Such connectors are disclosed in U.S. Pat. Nos. 4,512,618, 4,842,528, 4,938,704, 5,104,326 and 5,118,306 and Taiwan Patent Application Nos. 81205708, 81210870, 81210871, 81213628 and 83212722.

The conventional connectors have a common disadvantage. The complicated structure of the electromagnetic shielding and grounding devices result in a laborious assembly with a connector, thereby increasing manufacturing costs.

Furthermore, due to the complicated structure of the electromagnetic shielding and grounding devices, the conventional connectors is not provided with sufficient electromagnetic protection or electrostatic discharging capabilities.

Hence, an improved electrical connector is needed to eliminate the above mentioned defects of current electrical connectors.

SUMMARY OF THE INVENTION

Accordingly, an objective of the present invention is to provide an electrical connector having an electromagnetic shielding shell and grounding device with a simple structure for facilitating the assembly thereof.

Another objective of the present invention is to provide an electrical connector having an electromagnetic shielding shell and grounding device with improved shielding protection and electrostatic discharge capabilities.

To fulfill the above mentioned objectives, according to one embodiment of the present invention, an electrical receptacle connector comprises a dielectric housing having a first rectangular, hollow body portion defining a number of contact passageways interferentially receiving a corresponding number of conductive contacts therein and two ears on two lateral ends thereof. Each ear defines a central hole with an upper hexagonal section and a lower round section, and two elongate slits. Four mounting seats are formed by each ear around the corresponding upper hexagonal section of the corresponding central hole. A metallic shielding/grounding shell is formed to have a second rectangular, hollow body portion with two longitudinal sides and two lateral sides. Three engaging lugs integrally extend downward from each of the longitudinal sides. Two mounting wings integrally extend from the lateral sides, respectively. Each mounting wing forms a hexagonal hole, four mounting tongues around the hexagonal hole and a pair of soldering feet extending downward. A pair of grounding posts are each formed with a domed top section, a hexagonal middle section, and a cylindrical lower section defining a threaded recess therein.

To assemble the connector, the shielding/grounding shell is firstly mounted to the housing by extending the grounding feet through the slits, positioning the mounting tongues onto the mounting seats and fixedly engaging the engaging lugs with locking keys formed on the housing. When the shielding/grounding shell is mounted to the housing, the second body portion of the shielding/grounding shell covers the first body portion of the housing. The grounding posts are inserted into the hexagonal holes of the wings of the shielding/grounding shell and the central holes of the ears of the housing to reach a position in which the hexagonal sections of the posts fit with upper hexagonal sections of the central holes of the ears and urge the mounting tongues against the mounting seats, the lower cylindrical sections of the posts are fittingly received in the round sections of the central holes and the domed top sections are located above the second body portion of the shielding/grounding shell.

When the connector is mounted to a printed circuit board by inserting two screws through the PCB to threadedly engage with the lower cylindrical sections of the posts, the hexagonal sections of the posts urge the tongues against the mounting seats to securely fix the shielding/grounding shell to the housing. Due to cooperation between the domed upper section and a shielding/grounding shell of a mating connector, before the present connector electrically connects with the mating connector, electrostatic charges carried by the mating connector can be transmitted to ground by one of two paths: from the shielding/grounding shell of the mating connector via the posts to a grounding circuit on the PCB in connection with bottom faces of the posts, or from the shielding/grounding shell of the mating connector via the post, the shielding/grounding shell of the present connector and the grounding feet to the grounding circuit on the PCB.

DETAILED DESCRIPTION OF THE PREFERRED EMBODIMENTS

Figure 1:
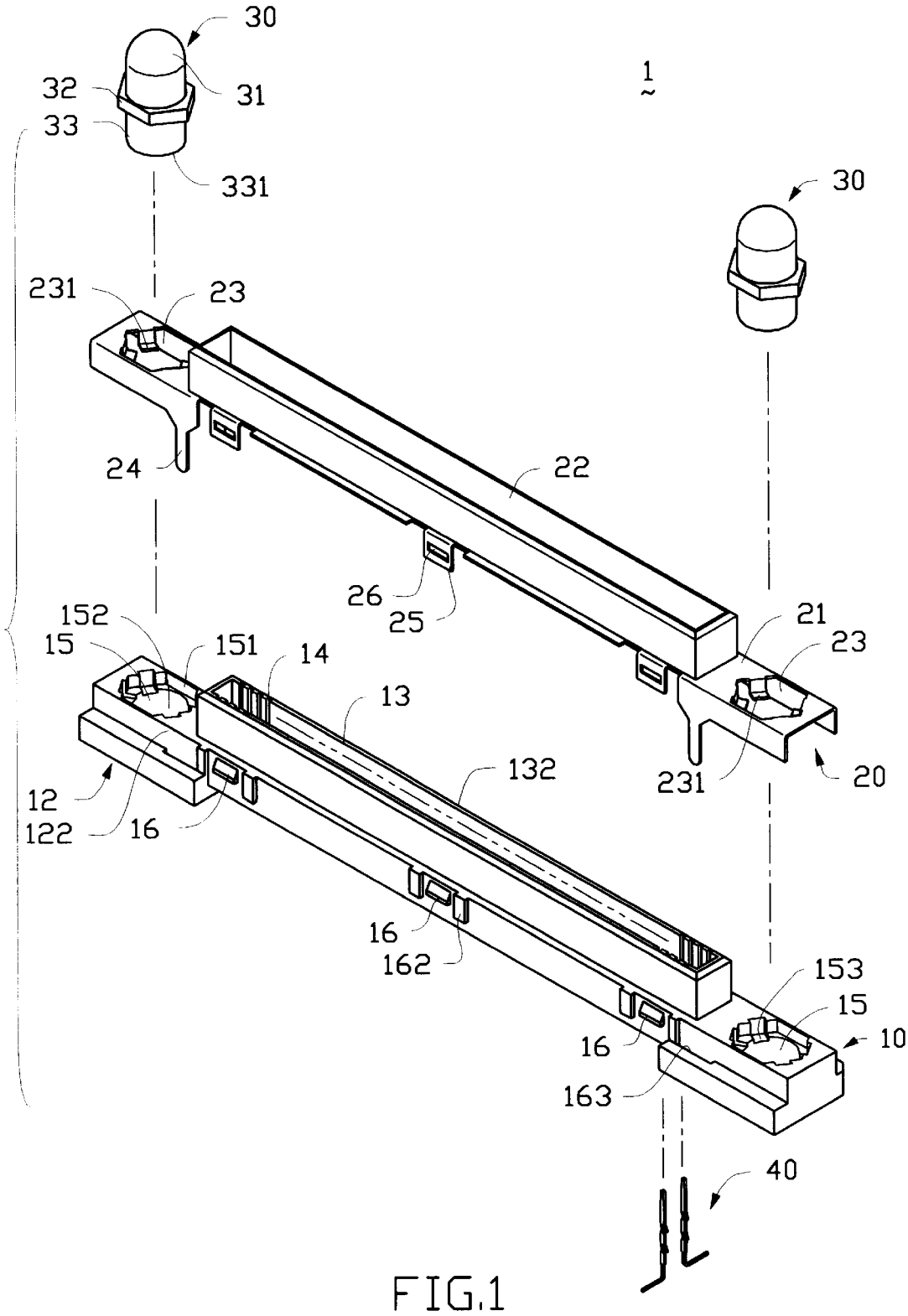
FIG. 1 is a perspective exploded view showing an electrical receptacle connector in accordance with a first embodiment of the present invention.

Reference will now be made in detail to the preferred embodiments of the present invention.

Referring to FIGS. 1–5, an electrical receptacle connector 1 in accordance with a first embodiment of the present invention includes a dielectric housing 10 formed by plastic injection molding. The housing 10 has a rectangular, hollow body portion 13 defining a number of contact passageways 14 for interferentially receiving a corresponding number of conductive contacts 40, and two laterally extending mounting ears 12. Each mounting ear 12 has a generally inverted T-shaped end cross section and defines two slits 163 and a central hole 15 with an upper hexagonal section 151 and a lower round section 152. Each mounting ear 12 further forms four mounting seats 153 around the corresponding upper hexagonal section 151 of the corresponding central hole 15. The housing 10 further forms three locking keys 16 on each longitudinal side of the body portion 13 of the housing 10, and two guides 162 beside each locking key 16. The body portion 13 has a mating connector engaging part 132 located between and above the mounting ears 12.

Figure 2:
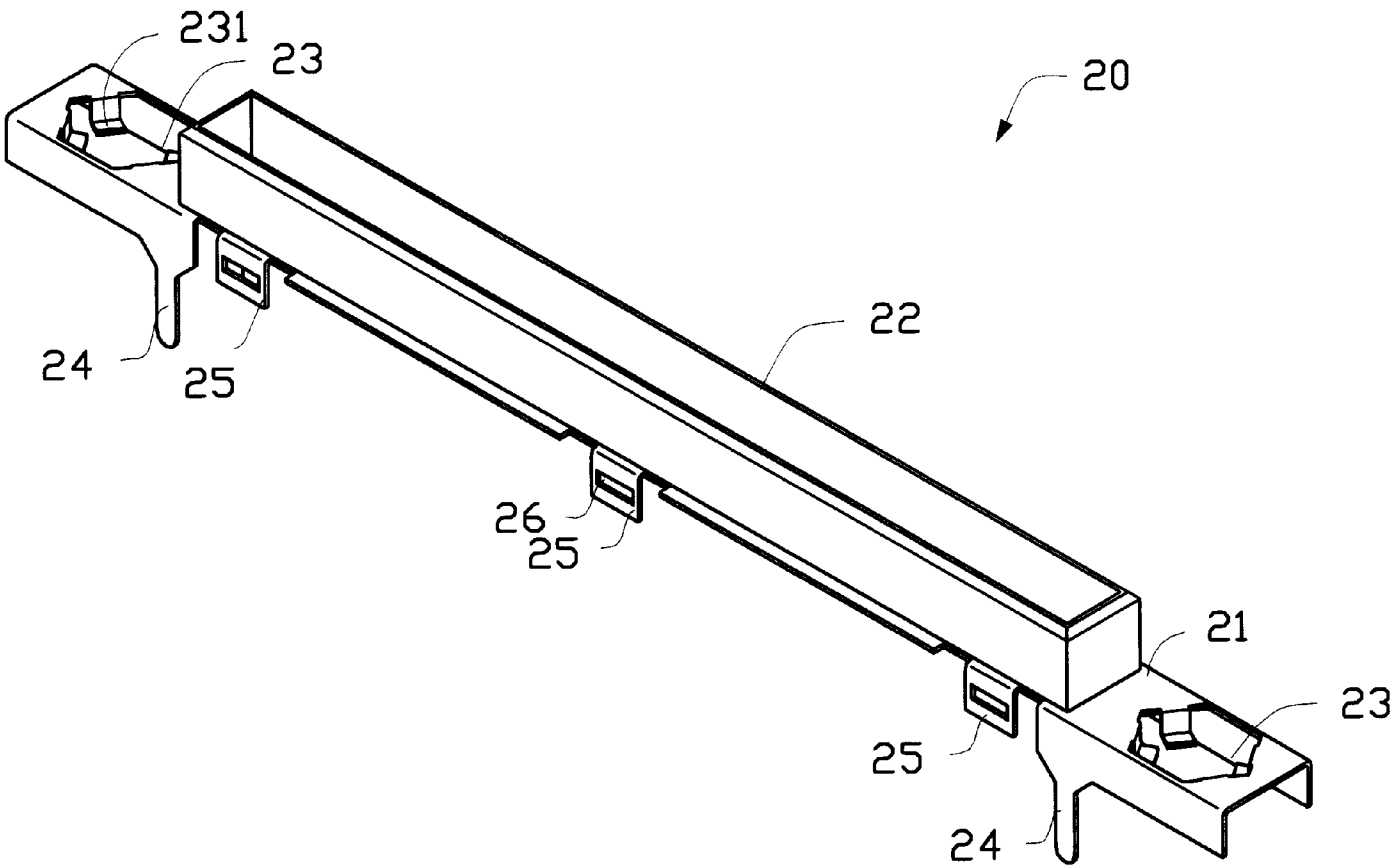
FIG. 2 is a perspective view showing a shielding/grounding shell of the connector of FIG. 1.
Figure 3:
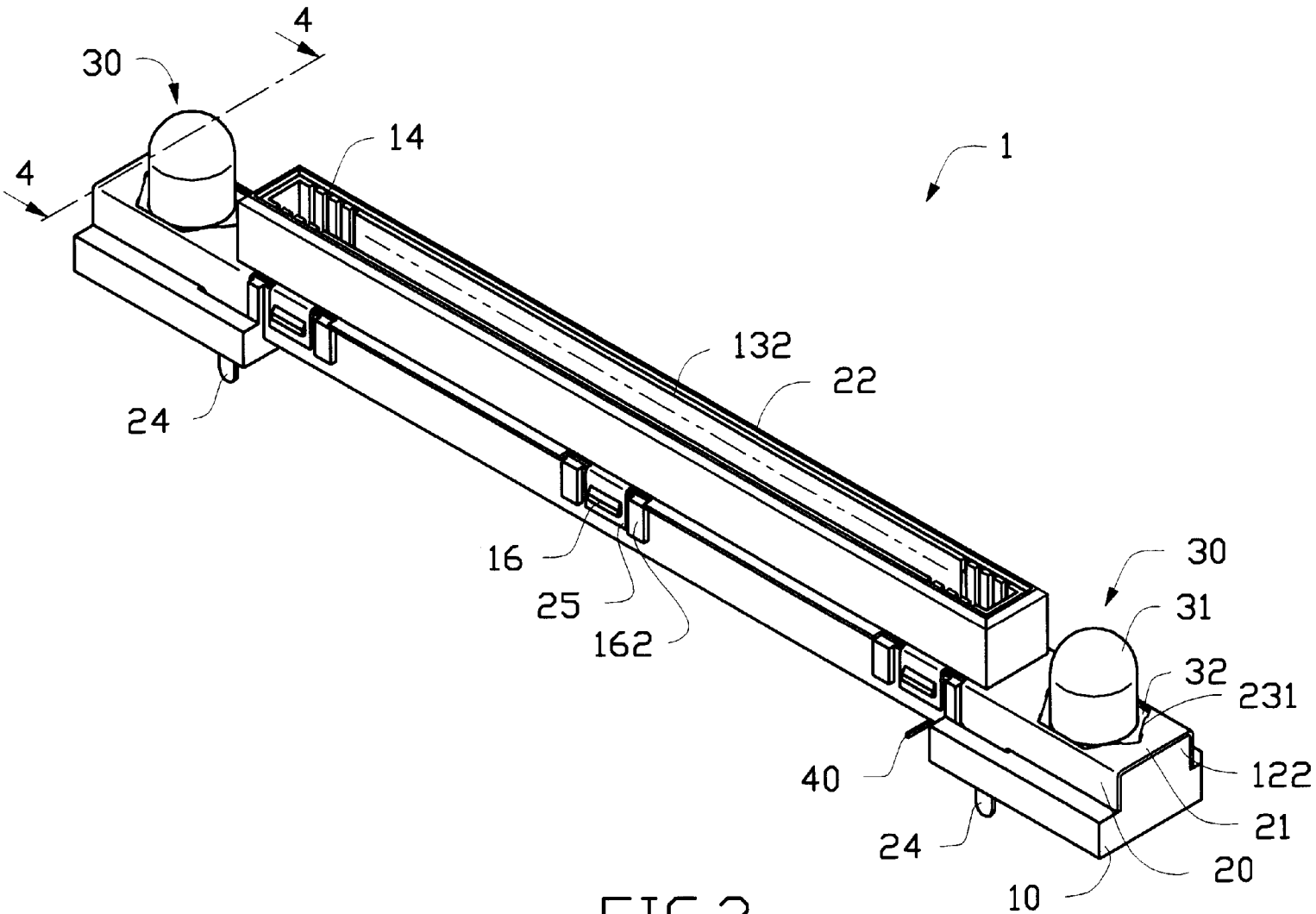
FIG. 3 is a perspective view of the assembled connector of FIG. 1.
Figure 4:
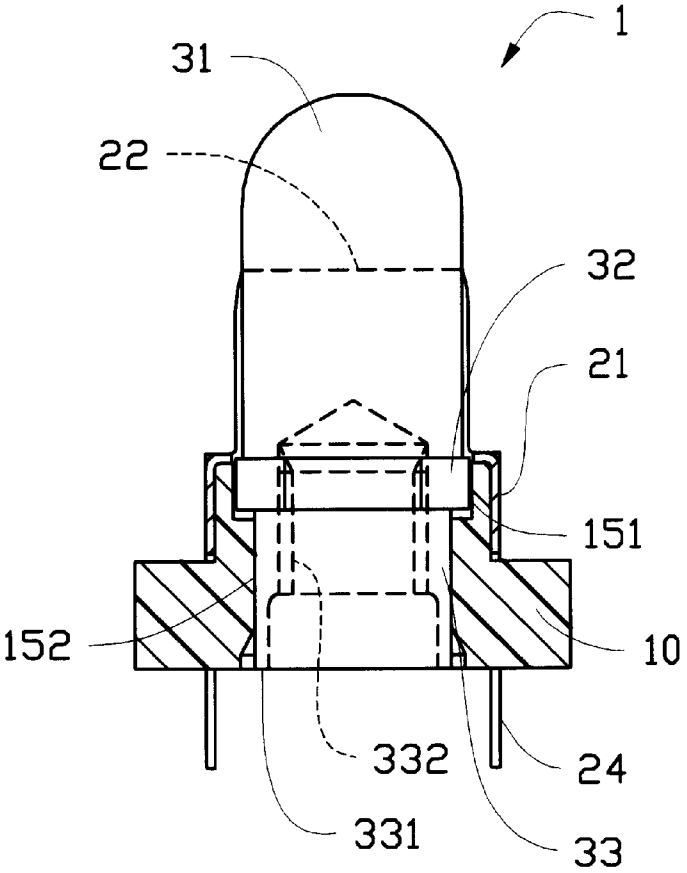
FIG. 4 is a cross-sectional view taken along line 4—4 of FIG. 3.
Figure 5:
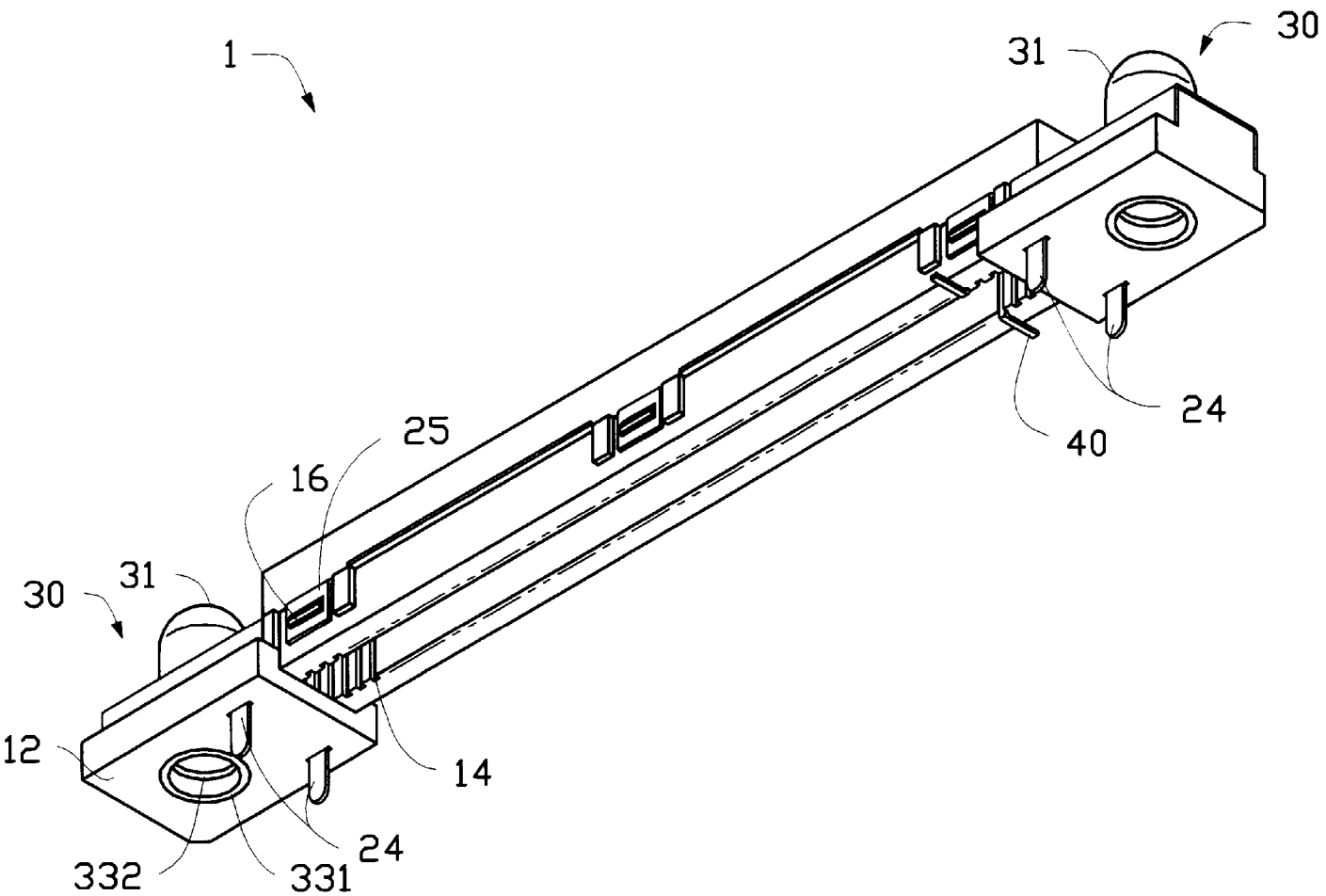
FIG. 5 is a bottom perspective view of the connector of FIG. 1.
Figure 6:
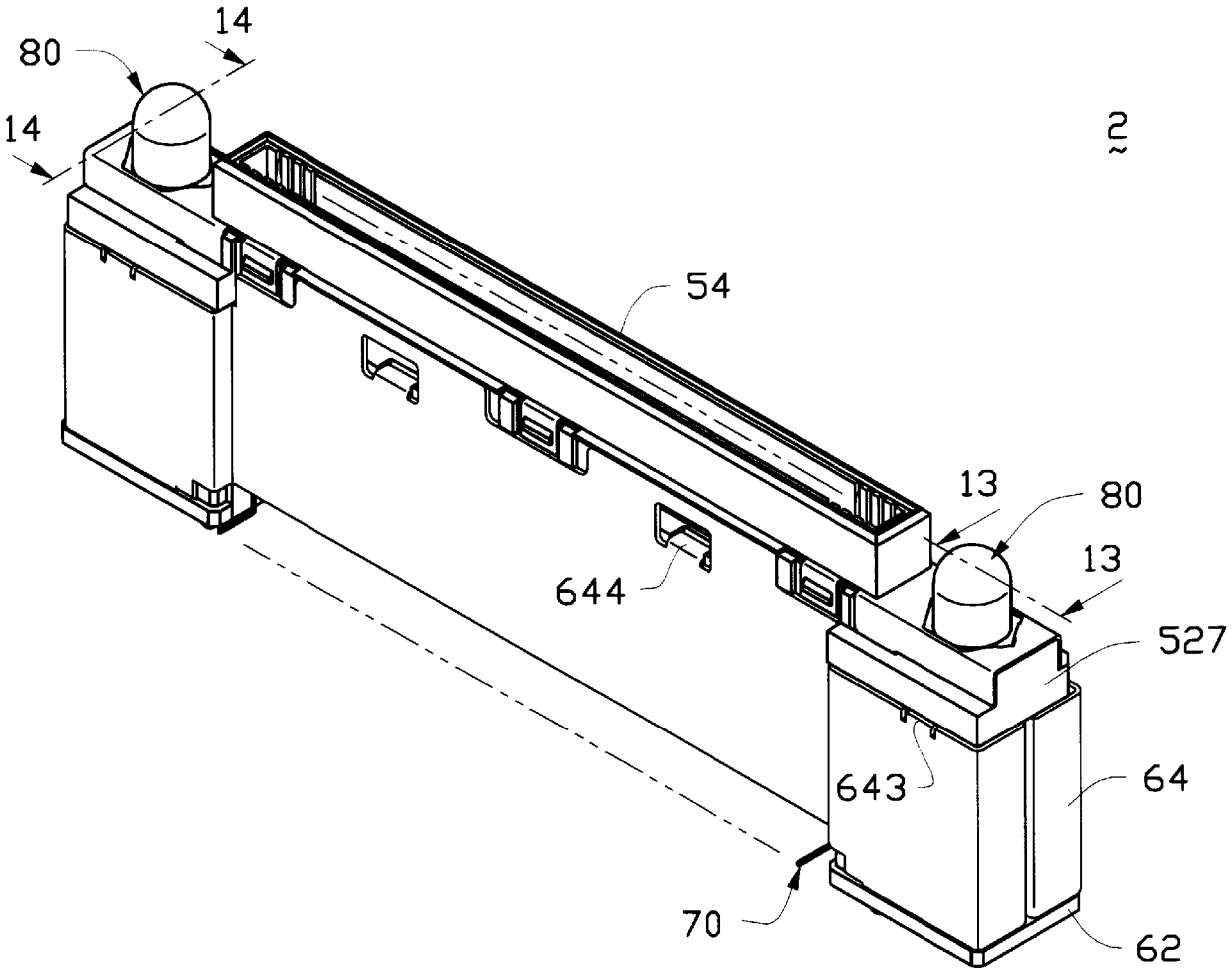
FIG. 6 is a perspective view showing an electrical receptacle connector in accordance with a second embodiment of the present invention.
Figure 7:
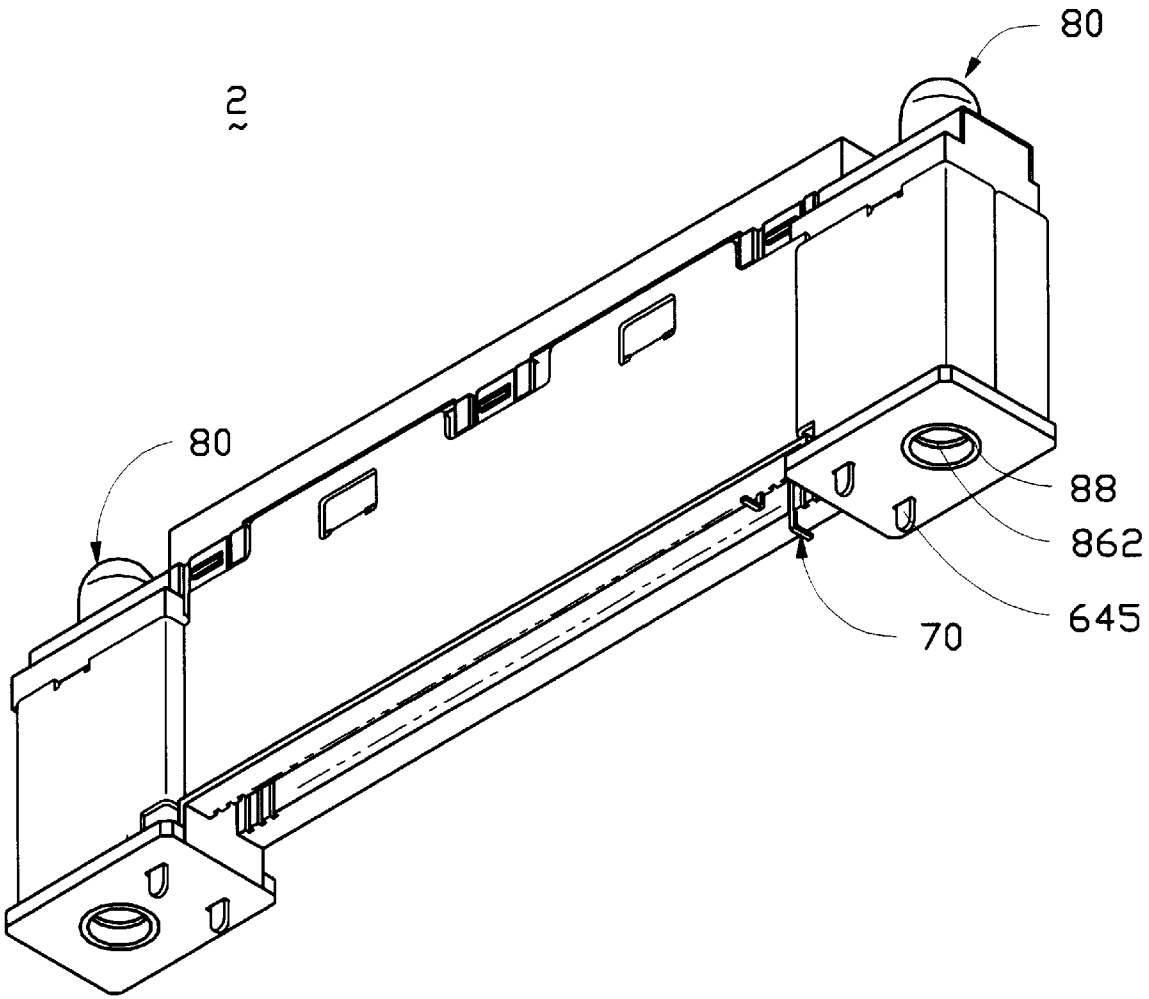
FIG. 7 is a bottom perspective view of the connector of FIG. 6.
Figure 8:
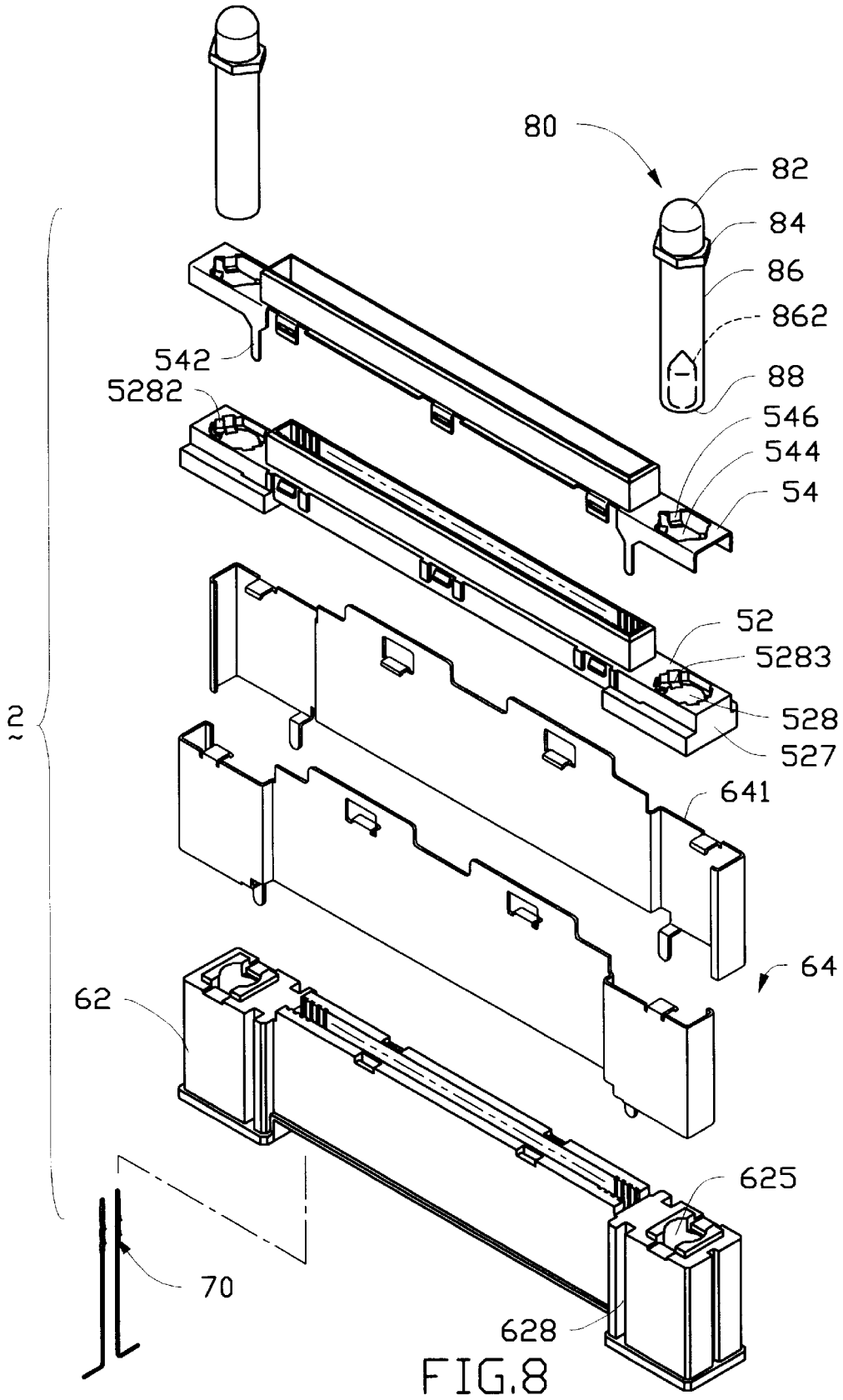
FIG. 8 is a perspective exploded view of the connector of FIG. 6.
Figure 9:
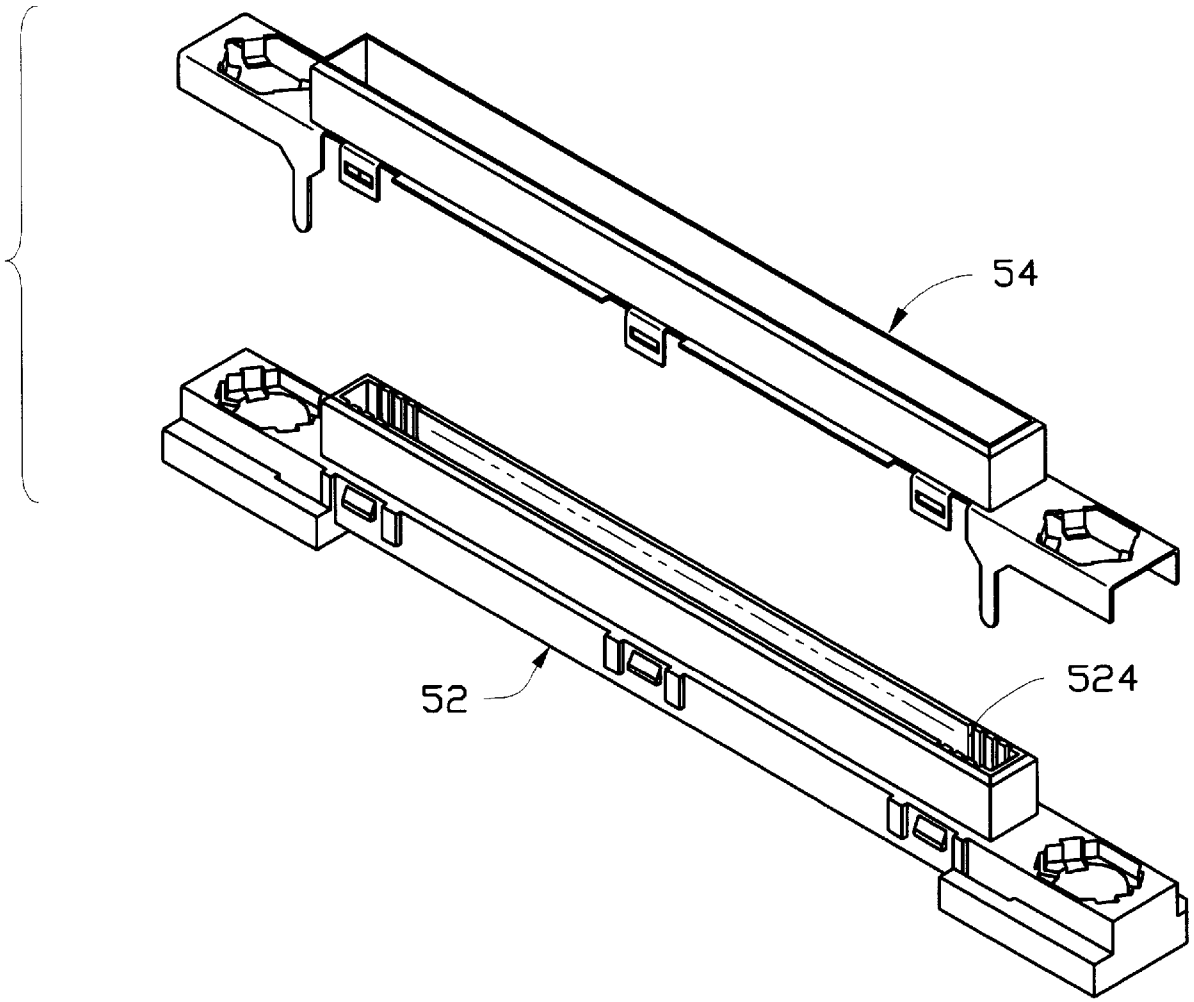
FIG. 9 is a perspective exploded view showing an upper housing and an upper shielding/grounding shell of the connector of FIG. 6.
Figure 10:
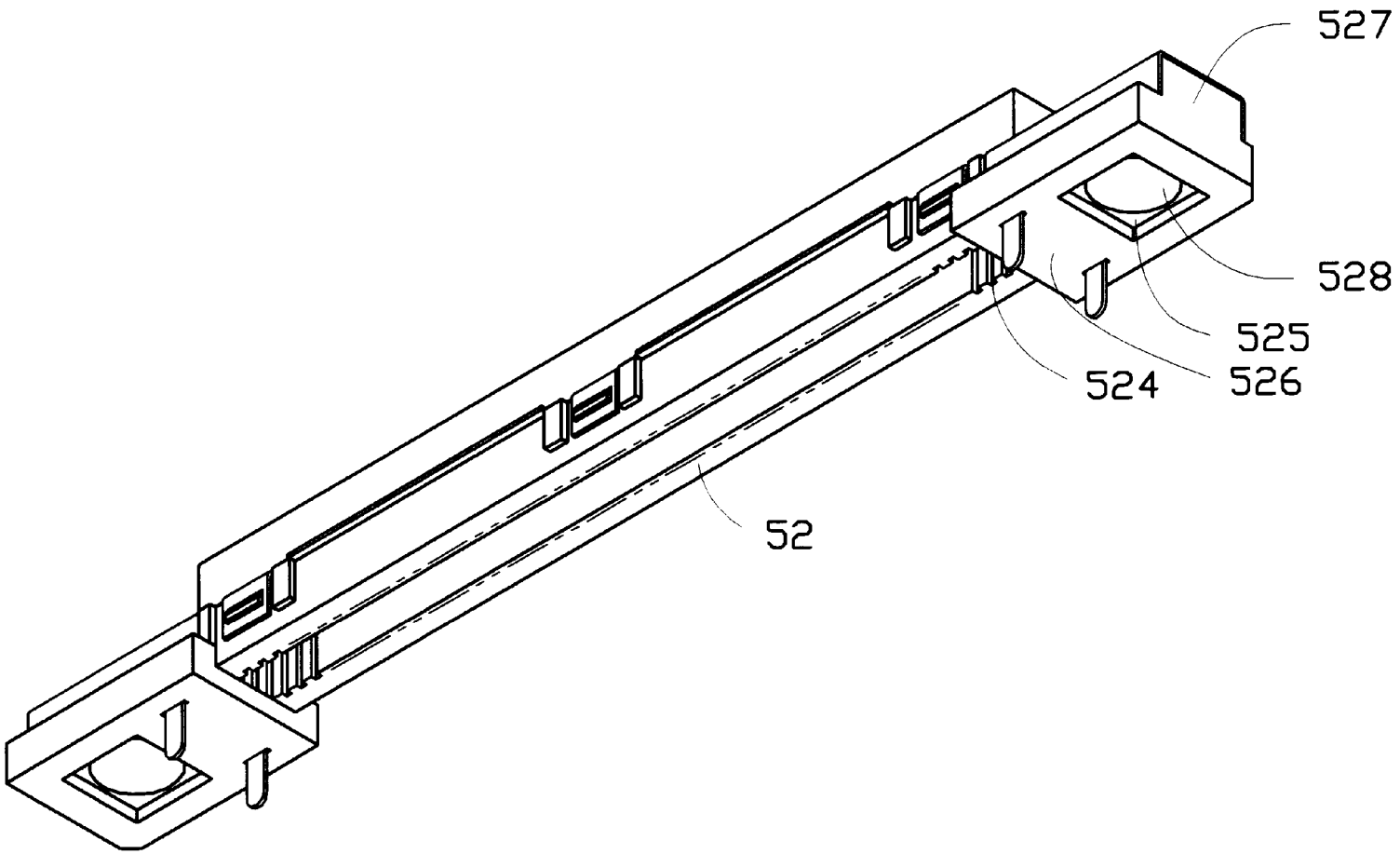
FIG. 10 is a bottom perspective view of the assembled upper housing and upper shielding/grounding shell of FIG. 9.

Particularly referring to FIG. 2, an electromagnetic shielding/grounding shell 20 is formed by stamping a metal sheet. The shell 20 is formed to have a rectangular, hollow body portion 22 with a configuration substantially the same as and a size slightly larger than the engaging part 132 of the body portion 13 of the housing 10. Three engaging lugs 25 integrally extend downward from each longitudinal side of the body portion 22. Each engaging lug 25 defines an elongate hole 26 therein. Two mounting wings 21 integrally extend outward from lateral ends of the body portion 22, respectively. Each mounting wing 21 has a generally inverted U-shaped end cross section, and forms a hexagonal hole 23, four mounting tongues 231 projecting into the hexagonal hole 23 and two downward extending grounding feet 24.

A pair of conductive grounding posts 30 are each formed with a domed upper section 31, a hexagonal middle section 32 and a cylindrical lower section 33 defining a bottom face 331 and a threaded hole 332 therein.

To assemble the connector 1, the contacts 40 are firstly mounted in the contact passageways 14 of the housing 10. The shielding/grounding shell 20 is then mounted to the housing 10 by extending the grounding feet 24 through the corresponding slits 163 and sliding the engaging lugs 25 over the corresponding locking keys 16 between the corresponding guides 162 to reach a locked position in which the locking keys 16 are fittingly received in the elongate holes 26 of the corresponding engaging lugs 25. The mounting tongues 231 are positioned on the corresponding mounting seats 153. The mounting wings 21 cover an upper part 122 of each of the mounting ears 12 and the body portion 22 covers the engaging part 132 of the body portion 13 of the housing 10. Finally, the grounding posts 30 are mounted to the housing 10 and the shielding/grounding shell 20 by extending the grounding posts 30 into the corresponding hexagonal holes 23 of the wings 21 of the shell 20 and the central holes 15 of the ears 12 of the housing 10 to reach a position in which the cylindrical lower sections 33 are fittingly received in the corresponding round lower sections 152 of the central holes 15, the hexagonal middle sections 32 are fittingly received in the corresponding hexagonal upper sections 151 of the central holes 15 thereby urging the mounting tongues 231 onto the corresponding mounting seats 153 and the domed upper sections 31 are located above the body portion 22 of the shielding/grounding shell 20 (best seen in FIG. 4).

To mount the connector 1 to a printed circuit board (not shown), the connector 1 is positioned on the PCB at a location where the grounding feet 24 extend through corresponding holes (not shown) of the PCB. Two screws (not shown) are then inserted from a bottom of the PCB to threadedly engage with the threaded holes 332 of the posts 30 to fixedly sandwich the PCB between heads of the screws and the bottom faces 331 of the posts 30 in which the hexagonal middle sections 32 of the posts 30 tightly urge the mounting tongues 231 against the mounting seats 153, whereby the shielding/grounding shell 20 is fixedly connected to the housing 10. The connector 1 and the PCB are then subject to a reflow soldering process to solder the contacts 40 and the grounding feet 24 to the PCB. When a mating plug connector (not shown) is mated to the connector 1 in accordance with the present invention, a shielding/grounding shell on the mating plug connector will firstly connect with the domed upper sections 31 of the grounding posts 30 to cause electrostatic charges carried by the mating connector to be transmitted to ground via the posts 30, the shielding/grounding shell 20, the grounding feet 24 and a grounding circuit on the PCB electrically connected with the grounding feet 24. Alternatively, the electrostatic charges can be transmitted to ground via the bottom faces 331 of the posts 30 if the bottom faces 331 of the posts are designed to be electrically connected with the grounding circuit of the PCB.

Referring to FIG. 6–14, an electrical receptacle connector in accordance with a second embodiment of the present invention includes an upper shielding/grounding shell 54 having a structure substantially the same as that of the shielding/grounding shell 20 of the first embodiment. An upper housing 52 is substantially the same as the housing 10 of the first embodiment except a square recess 525 is defined in each bottom surface 526 of mounting ears 527 of the upper housing 52 below a central hole 528 thereof (best seen in FIG. 10).

The major difference between the first and second embodiments is that the second embodiment further has a lower housing 62 and a lower shielding/grounding shell 64 whereby the total height of the connector 2 is larger in comparison with the connector 1 of the first embodiment for meeting a different required application. The advantage of the second embodiment is that the height of the connector 2 is increased without changing the upper housing 52 and the upper shielding/grounding shell 54.

Figure 11:
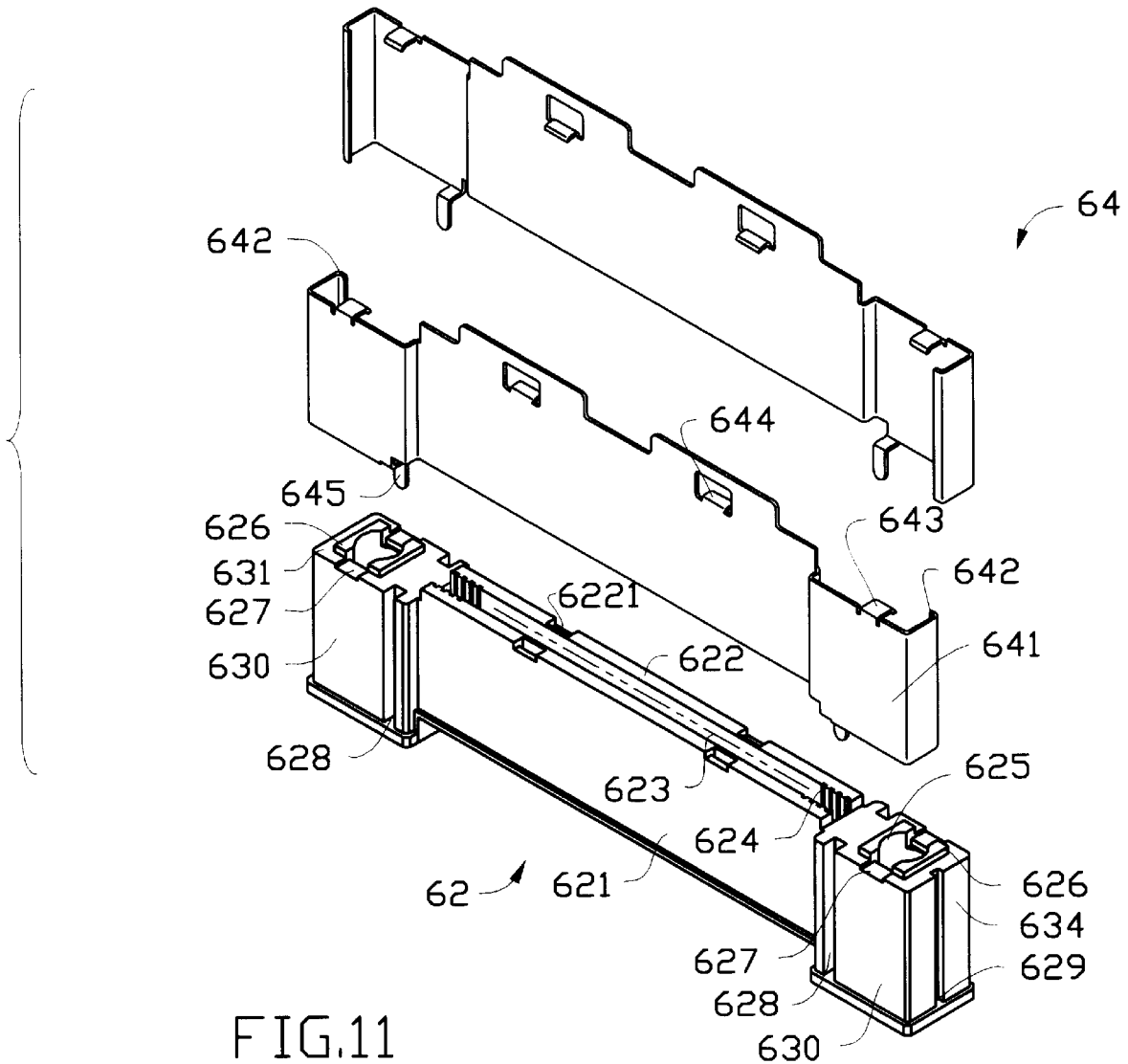
FIG. 11 is a perspective exploded view showing a lower housing and a lower shielding/grounding shell of the connector of FIG. 6.
Figure 12:
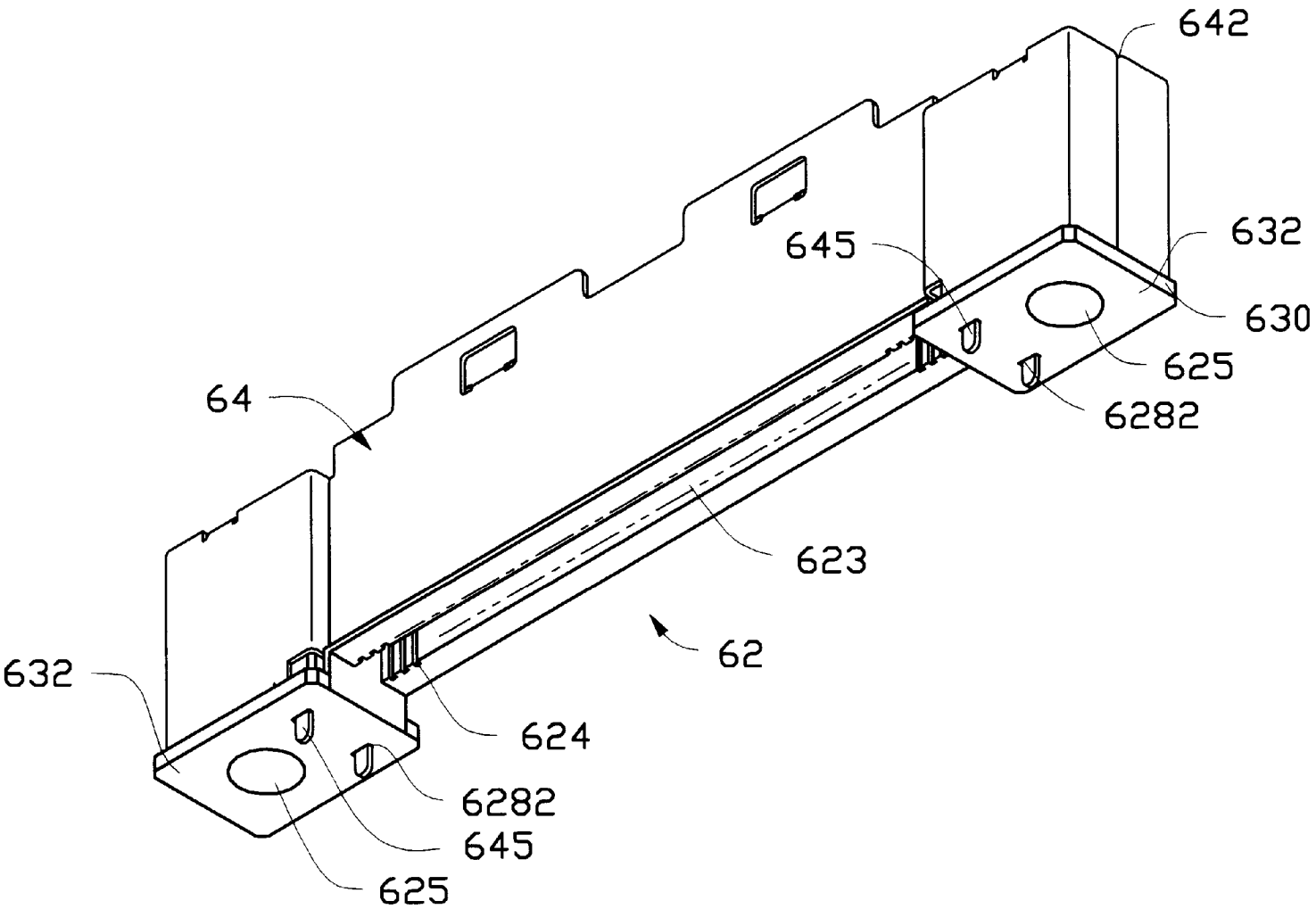
FIG. 12 is a bottom perspective view of the assembled lower housing and shielding/grounding shell of FIG. 11.

Particularly referring to FIG. 11, the lower housing 62 is formed to have an elongate, hollow body portion 621 with two pairs of shell engaging tabs 6221 defined in a top face 622 thereof. The body portion 621 further defines a central slot 623 and two rows of contact passageways 624 beside the central slot 623. The lower housing 62 is further integrally formed with two columns 630 at two lateral ends thereof, respectively. Each column 630 has a top face 631 formed with a pair of locating protrusions 626 and a pair of engaging blocks 627 between and below the locating protrusions 626. A pair of elongate guiding grooves 628 are respectively defined in a front and rear face of each of the columns 630.

Each column 630 further defines a mounting groove 629 along an outer side 634 thereof and a central round hole 625 therein.

In the present embodiment, the lower shielding/grounding shell 64 is formed as a pair of separate identical pieces 641 each having two mounting edges 642 on two lateral ends thereof, a pair of long engaging jaws 643 extending from a top edge of two lateral portions thereof, a pair of short engaging jaws 644 extending from an upper, middle portion thereof, and two grounding feet 645 extending downward from a bottom edge thereof.

Two grounding posts 80 each have a configuration similar to that of the grounding posts 30 of the first embodiment but with a lower cylindrical section 86 much longer than the lower cylindrical section 33 of the grounding posts 30. Each grounding post 80 consists of a domed upper section 82, a hexagonal section 84 and the lower cylindrical section 86 defining a bottom face 88 and a threaded hole 862 therein.

A number of contacts 70 each have a configuration similar to that of the contacts 40 but with a longer length.

To assemble the connector 2, the upper shielding/grounding shell 54 is mounted to the upper housing 52 in the same manner as the assembly of the housing 10 and the shielding/grounding shell 20 of the connector 1 of the first embodiment. Thereafter, the two pieces 641 of the lower shielding/grounding shell 64 are successively mounted to the lower housing 62 by extending the mounting edges 642 into the mounting grooves 629 and the grounding feet 645 into the guiding grooves 628 to reach a fixed position in which the long engaging jaws 643 engage with the engaging blocks 627, the short engaging jaws 644 engage with the shell engaging tabs 6221 and the grounding feet 645 extend through holes 6282 defined in bottom surfaces 632 of the columns 630, respectively (best seen in FIG. 12).

The upper and lower housings 52,62 and upper and lower shielding/grounding shells 54, 64 are connected together by fitting the protrusions 626 into the rectangular recesses 525 of the upper housing 52. Grounding feet 542 of the upper shielding/grounding shell 54 extend into the guiding grooves 628, respectively, and contact passageways 524 of the upper housing 52 are aligned with the corresponding contact passageways 624 of the lower housing 62.

Thereafter, the upper and lower housings 52, 62 and the upper and lower shielding/grounding shells 54, 64 are secured together so that the contacts 70 can be interferentially mounted into the contacts passageways 624 and 524.

Figure 14:
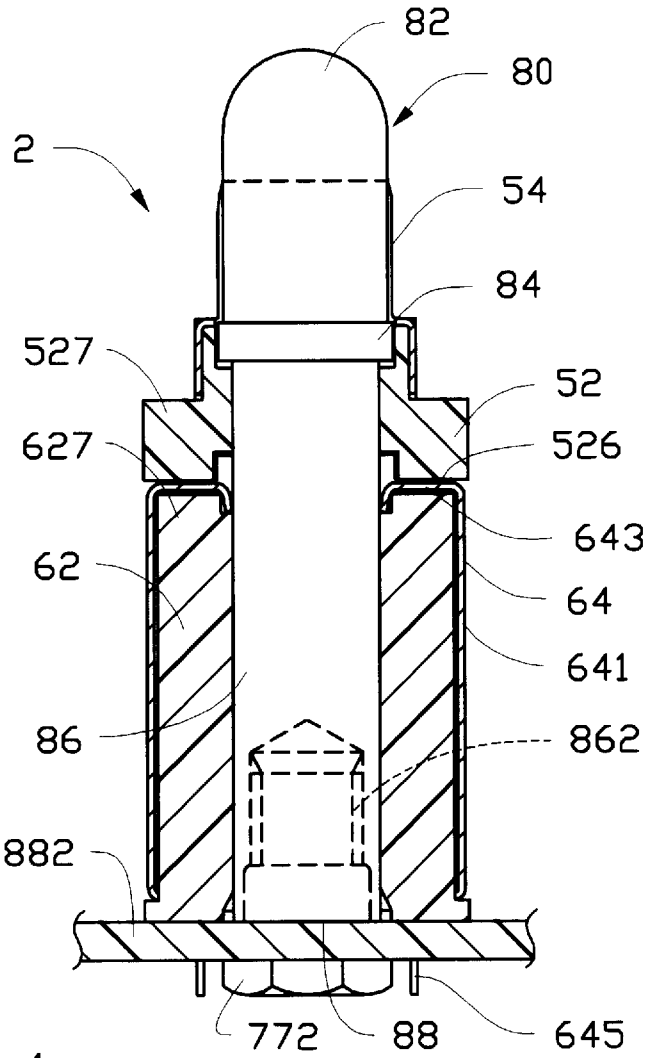
FIG. 14 is a cross-sectional view taken along line 14—14 of FIG. 6 with the connector being mounted on a print circuit board by two screws.

Finally, the grounding posts 80 are extended through hexagonal holes 544 of the upper shielding/grounding shell 54, the central holes 528 of the upper housing 52 and the round holes 625 of the lower housing 62 to reach a position wherein the hexagonal sections 84 of the posts 80 fit with hexagonal upper sections 5282 of the central holes 528 of the upper housing 52 and the lower cylindrical sections 86 of the posts 80 are fittingly received in the round holes 625 to contact with the long engaging jaws 643 of the lower shielding/grounding shell 64 (best seen in FIG. 14).

Figure 13:
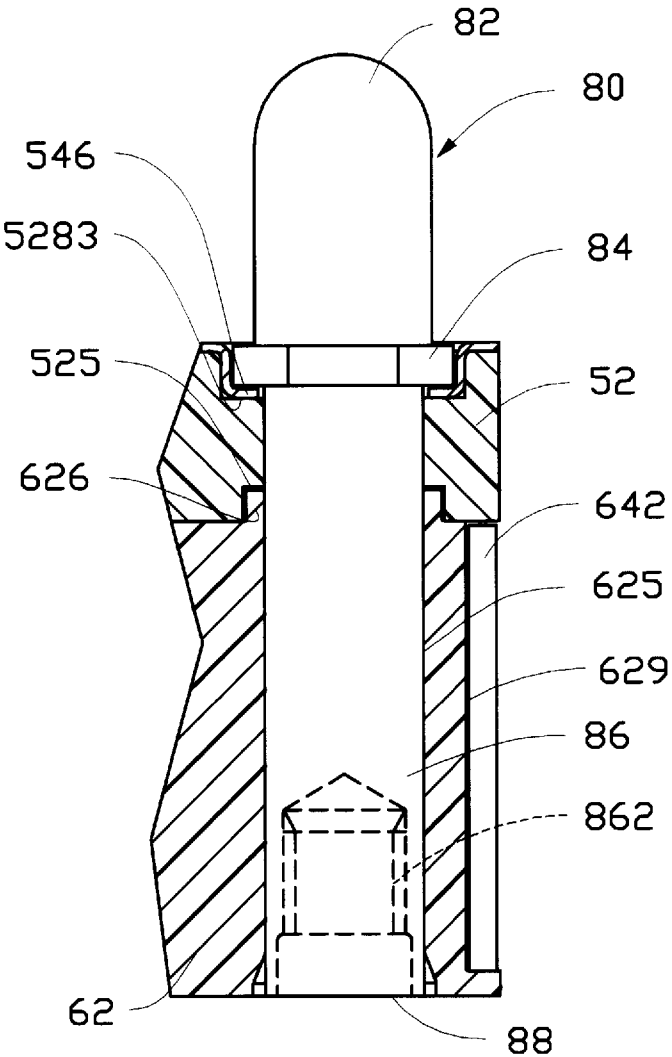
FIG. 13 is a cross-sectional view taken along line 13—13 of FIG. 6.

As shown in FIGS. 13 and 14, when mounting the connector 2 to a printed circuit board 882 by extending the grounding feet 645 through corresponding holes (not shown) in the PCB 882 and threadedly fastening two screws 772 (only one shown) to the threaded holes 862, the screws 772 pull the grounding posts 80 downward causing the hexagonal sections 84 of the posts 80 to tightly urge mounting tongues 545 of the upper shielding/grounding shell 54 against mounting seats 5283 of the upper housing 52, and the bottom surfaces 526 of the mounting ears 527 of the upper housing 52 tightly urge the long engaging jaws 643 against the engaging blocks 627, whereby the upper and lower shielding/grounding shells 54, 64 are securely fixed to the connector 2, and the connector 2 is fixedly mounted to the PCB 882.

Like the first embodiment, electrostatic charges carried by a mating connector of the connector 2 can be transmitted to ground via one of the following two paths: through the upper domed sections 82 of the grounding posts 80, the lower shielding/grounding shell 64 and the grounding feet 645 to a grounding circuit on the PCB in electrical connection with the grounding feet 645, or through the grounding posts 80 directly when the grounding circuit is designed to extend to electrically connect with the bottom faces 88 of the grounding posts 80.

Figure 15:
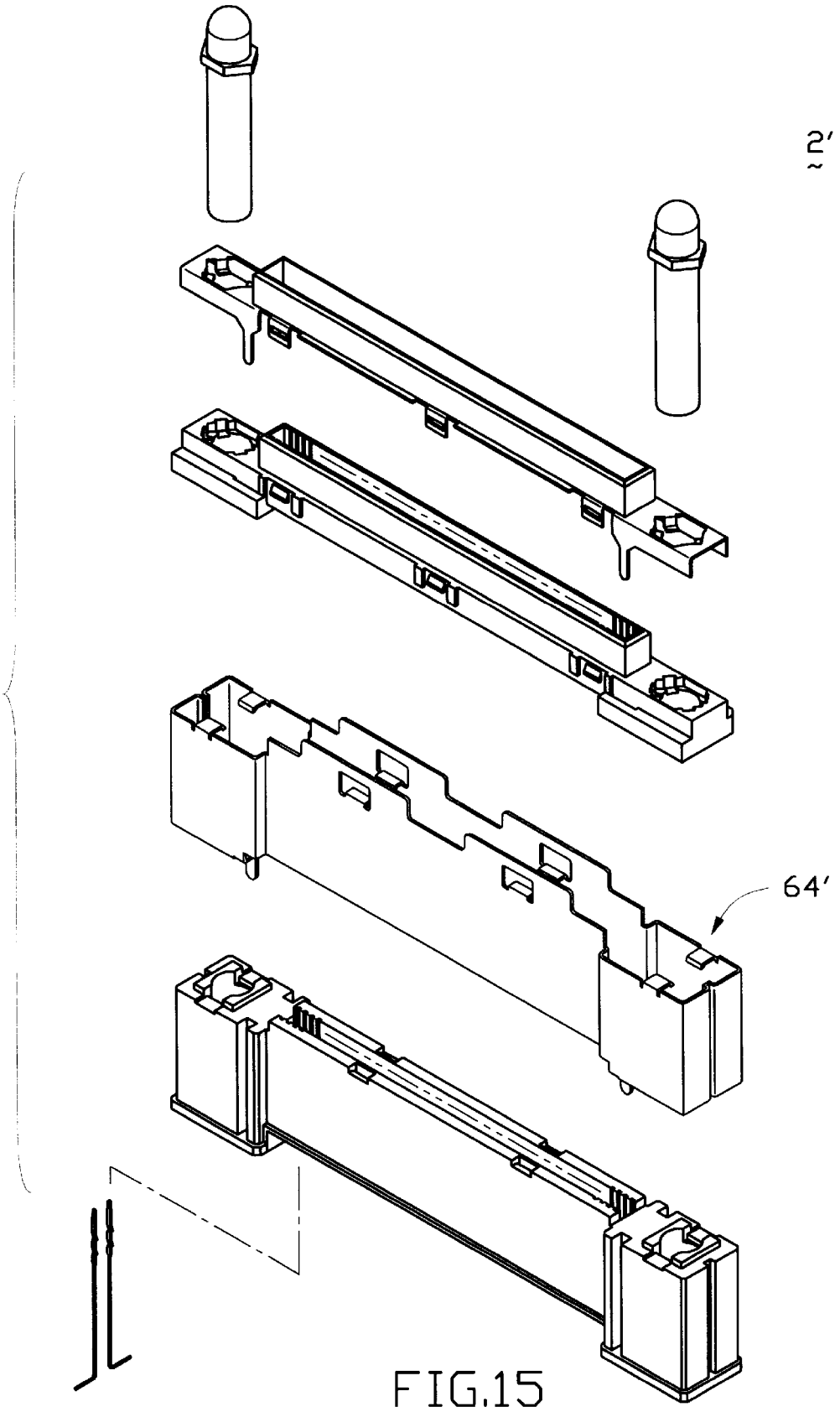
FIG. 15 is a perspective exploded view showing an electrical receptacle connector in accordance with a third embodiment of the present invention.

FIG. 15 shows a connector 2' in accordance with a third embodiment of the present invention wherein the only difference between the third and second embodiments is that the lower shielding/grounding shell 64' of the third embodiment is integrally formed as one piece.

Figure 16:
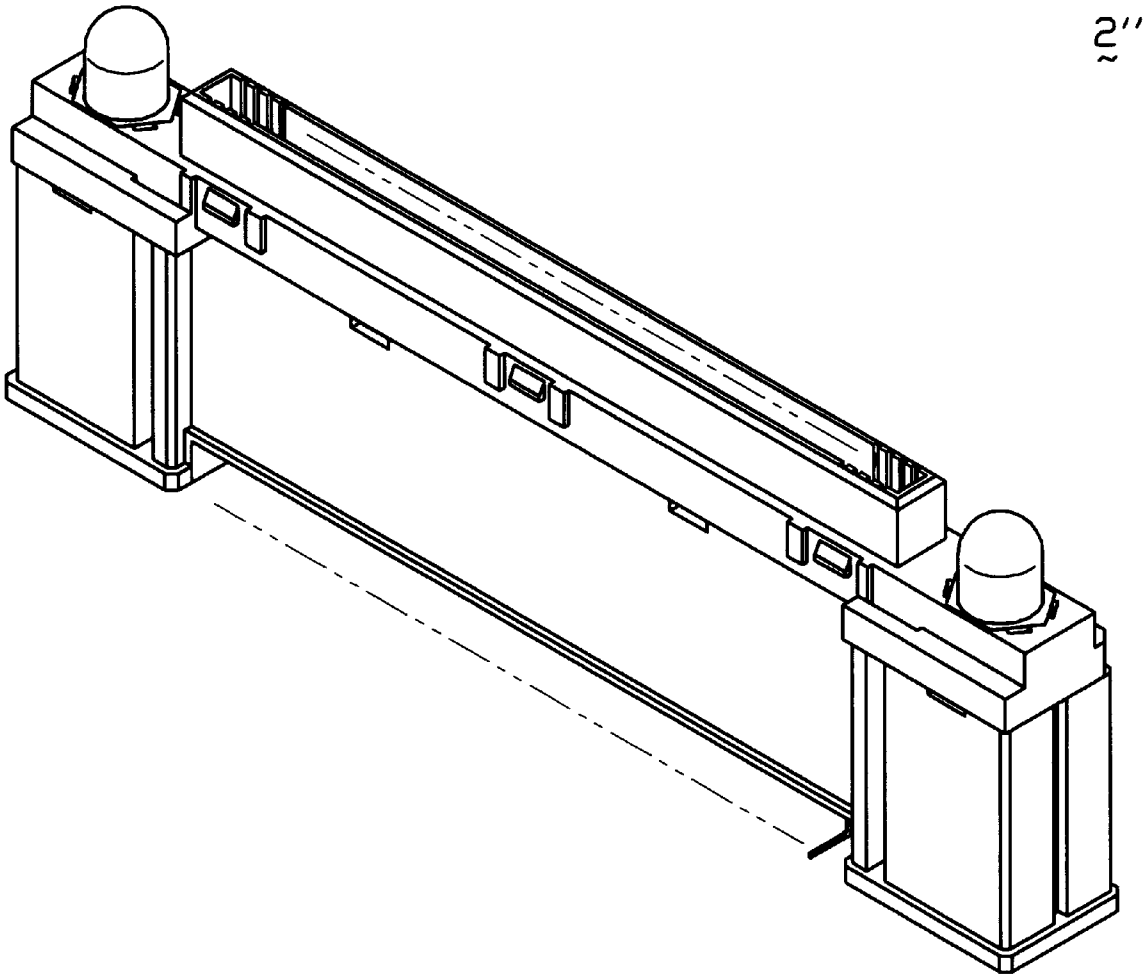
FIG. 16 is a perspective view showing an electrical receptacle connector in accordance with a fourth embodiment of the present invention.

FIG. 16 shows a connector 2" in accordance with a fourth embodiment of the present invention which is substantially the same as the second embodiment except that the fourth embodiment is not equipped with the upper and lower shielding/grounding shells 54, 64. Thus, the connector 2" does not have shielding capabilities. The printed circuit board upon which the connector 2" is mounted should have a grounding circuit extending to electrically connect with the bottom faces of the grounding posts, whereby electrostatic charges carried by a mating connector (not shown) to be connected to the connector 2" can be transmitted to ground by the grounding posts.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical connector comprising:

a dielectric housing having a first face for engaging with a mating connector, a second face opposite the first face, a number of contact passageways defined between the first and second faces for receiving a number of contacts therein, a first hole and a mounting seat beside the first hole;

a conductive shielding/grounding shell covering the housing and having a second hole and a mounting tongue beside the second hole; and a conductive post having an upper section located above the first face of the housing, a middle section fittingly received in the first and second holes and urging the mounting tongue against the mounting seat, and a lower section defining a threaded hole therein forming a bottom face flush with the second face of the housing for contacting grounding circuitry of a circuit board, on which the connector is mounted.

2. The connector in accordance with claim 1, wherein the conductive shielding/grounding shell further has a grounding foot extending beyond the second face of the housing.

3. The connector in accordance with claim 1, wherein the middle section of the post has a polygonal configuration.

4. The connector in accordance with claim 1, wherein the middle section of the post has a hexagonal configuration.

5. The connector in accordance with claim 1, wherein the upper section of the post has a domed configuration.

6. A combination of a connector and a printed circuit board, comprising:

a connector comprising:

a dielectric housing having a first face for engaging with a mating connector, a second face opposite the first face, a number of contact passageways defined between the first and second faces for receiving a number of contacts therein and a mounting ear having a first hole and a mounting seat beside the first hole;

a conductive shielding/grounding shell covering the housing and having a mounting wing with a second hole and a mounting tongue beside the second hole; and a conductive post having an upper section located above the first face of the housing, a middle section fittingly received in the first and second holes and urging the mounting tongue against the mounting seat and a lower section defining a threaded hole therein;

a printed circuit board contacting the second face of the housing; and a screw extending through the printed circuit board to threadedly engage with the threaded hole of the post and causing the middle section of the post to tightly urge the mounting tongue against the mounting seat thereby simultaneously fixing the shielding/grounding shell to the housing and the connector to the printed circuit board.

7. The electrical connector in accordance with claim 6, wherein the printed circuit board has a grounding circuit electrically connecting with the post.

8. The electrical connector in accordance with claim 6, wherein the shielding/grounding shell has a grounding foot extending beyond the second face of the housing to electrically connect with a grounding circuit on the printed circuit board.

9. The electrical connector in accordance with claim 6, wherein the middle section of the post has a hexagonal configuration.

10. An electrical connector, comprising:

a first dielectric housing having a first face for engaging with a mating connector, a second face opposite the first face, a number of first contact passageways defined between the first and second faces;

a second dielectric housing having a third face engaging with the second face, a fourth face opposite the third face and a number of second contact passageways defined between the third and fourth faces and in alignment with the corresponding first contact passageways;

a number of contacts interferentially received in the first and second contact passageways;

a conductive post having a domed upper section located above the first face, a polygonal middle section fitting received in the first housing, and a lower section received in the second housing and defining a threaded hole therein.

11. The electrical connector in accordance with claim 10 further comprising:

a first conductive shielding/grounding shell covering the first housing; and a second conductive shielding/grounding shell covering the second housing and having an engaging jaw engaging with the second housing, sandwiched between the second and third faces and in contact with the post; wherein the polygonal middle section of the post urges a part of the first conductive shielding/grounding shell against the first housing.

12. The connector in accordance with claim 11, wherein the first housing comprises a recess on the second face and the second housing comprises a protrusion on the third face, said protrusion fittingly extending into the recess.

13. The connector in accordance with claim 12, wherein the engaging jaw engages an engaging block defined by the third face below the protrusion.

14. The connector in accordance with claim 11 wherein the second shielding/grounding shell comprises a grounding foot extending beyond the fourth face.

15. The connector in accordance with claim 11 wherein the second shielding/grounding shell consists of two identical pieces each having two mounting edges on two literal ends thereof, respectively, said mounting edges extending into mounting grooves defined in two lateral ends of the second housing.

16. The connector in accordance with claim 10, wherein the lower section of the post has a bottom face flush with the fourth face of the second housing.

17. A combination of an electrical connector and a printed circuit board, comprising:

a connector, comprising:

a first dielectric housing having a first face for engaging with a mating connector, a second face opposite the first face and a number of contact passageways defined between the first and second faces;

a second dielectric housing having a third face engaging with the second face and a fourth face opposite the third face;

a conductive post having an upper section located above the first face, a polygonal middle section fittingly received in the first housing and a lower section received in the second housing and defining a bottom face and a threaded hole therein;

a printed circuit board having a fifth face in contact with the fourth face, a sixth face opposite the fifth face, and a grounding circuit located on the fifth face and extending to electrically connect with the bottom face of the conductive post;

a number of contacts received in the contact passageways and having terminal portions soldered to the printed circuit board; and a screw extending from the sixth face through the printed circuit board to threadedly engage with the lower section of the post to connect the first and second housings together to the printed circuit board.

18. A combination of an electrical connector and a printed circuit board, comprising;

a connector, comprising:

a first dielectric housing having a first face for engaging with a mating connector, a second face opposite the first face and a number of first contact passageways defined between the first and second faces;

a second dielectric housing having a third face engaging with the second face, a fourth face opposite the third face and a number of second contact passageways defined between the third and fourth faces and in alignment with the first contact passageways;

a conductive post having a domed upper section located above the first face, a polygonal middle section fittingly received in the first housing and a lower section received in the second housing and defining a threaded hole therein;

a conductive shielding/grounding shell covering the second housing and having an engaging jaw engaging with the second housing, sandwiched between the second and third faces and in contact with the conductive post, and a grounding foot extending beyond the fourth face;

a printed circuit board having a fifth face in contact with the fourth face, a sixth face opposite the fifth face, and a grounding circuit electrically connected with the grounding foot of the shielding/grounding shell;

a number of contacts interferentially received in the first and second contact passageways and having terminal portions soldered to the printed circuit board; and a screw extending from the sixth face through the printed circuit board to thrededly engage with the lower section of the post to cause the first and second housings and the shielding/grounding shell to be fixed together to the printed circuit board.

19. The combination in accordance with claim 18, wherein the shielding/grounding shell is formed as a single piece.

20. An electrical connector assembly including:

a first dielectric housing having a first face for engaging with a mating connector, a second face opposite the first face and a number of first contact passageways defined between the first and second faces;

a first shielding/grounding shell enclosing said first housing;

a second dielectric housing having a third face engaging with the second face of the first housing, a fourth face opposite the third face and a number of second contact passageways defined between the third and fourth faces and in alignment with the corresponding first passageways, respectively;

a second shielding/grounding shell enclosing said second housing; and a conductive post extending through the first and second housings, having an upper section located above the first face of the first housing, a middle section urging a mounting tongue of the first shielding/grounding shell against the first housing, and a lower section defining a threaded hole therein forming a bottom face thereof flush with the fourth face of the second housing and contacting grounding circuitry of a circuit board, on which the connector assembly is mounted; and a screw extending through the circuit board and threadedly engaging with the threaded hole of the conductive post.

21. An arrangement of eliminating electro-magnetic interference of a connector assembly, comprising:

a first housing defining a first hole;

a first shielding/grounding shell enclosing said first housing;

a second housing defining a second hole in alignment with said first hole;

a second shielding/grounding shell enclosing said second housing; and at least one conductive post including a first section received within the first hole of the first housing and contacting said first shell, and a second section opposite to said first section, received within the second hole of the second housing and contacting the second shell.

22. The electrical assembly in accordance with claim 20, wherein the second shielding/grounding shell comprises a pair of separate identical pieces, each having two mounting edges on two lateral ends thereof.

23. The electrical connector assembly in accordance with claim 22, wherein each separate piece comprises a pair of long engaging jaws extends from a top edge of two lateral portion thereof, and a pair of short engaging jaws between the long engaging jaws.

24. The electrical connector assembly in accordance with claim 22, wherein each separate piece comprises a pair of grounding feet extends downward from a bottom edge thereof.

* * * * *